US007546733B2

(12) United States Patent
Nakada et al.

(10) Patent No.: US 7,546,733 B2
(45) Date of Patent: Jun. 16, 2009

(54) METHOD FOR CONTROLLING OPERATION OF CYLINDER APPARATUS

(75) Inventors: Takeshi Nakada, Tsuchiura (JP); Kazuhiro Tanaka, Chikushino (JP); Yasuo Sakurai, Kazo (JP); Hiromichi Kajikawa, Ibaraki-ken (JP); Takeshi Seo, Nagareyama (JP)

(73) Assignee: SMC Kabushiki Kaisha, Tokyo (JP)

( * ) Notice: Subject to any disclaimer, the term of this patent is extended or adjusted under 35 U.S.C. 154(b) by 95 days.

(21) Appl. No.: 11/469,662

(22) Filed: Sep. 1, 2006

(65) Prior Publication Data

US 2007/0051405 A1 Mar. 8, 2007

(30) Foreign Application Priority Data

Sep. 8, 2005 (JP) ..... 2005-260556

(51) Int. Cl.
*F01B 21/04* (2006.01)

(52) U.S. Cl. ..... 60/711

(58) Field of Classification Search ..... 60/711
See application file for complete search history.

(56) References Cited

U.S. PATENT DOCUMENTS

| | | | | |
|---|---|---|---|---|
| 4,517,853 | A * | 5/1985 | Tani et al. | 74/89.32 |
| 4,807,518 | A * | 2/1989 | Berchtold et al. | 91/421 |
| 5,439,200 | A | 8/1995 | Braesch et al. | |
| 5,484,051 | A | 1/1996 | Nagai et al. | |
| 5,614,778 | A | 3/1997 | Terao et al. | |

FOREIGN PATENT DOCUMENTS

| | | | |
|---|---|---|---|
| DE | 44 36 045 | | 4/1995 |
| DE | 694 00 564 | | 4/1997 |
| DE | 694 32 319 | * | 8/2003 |
| JP | 60-146955 | | 8/1985 |
| JP | 63-061006 | | 4/1988 |
| JP | 04-057595 | | 9/1992 |
| JP | 06-074202 | | 3/1994 |
| JP | 7-110005 | | 4/1995 |
| JP | 07-110014 | | 4/1995 |
| JP | 07-119712 | | 5/1995 |
| JP | 9-190222 | | 7/1997 |
| JP | 9-210014 | | 8/1997 |
| JP | 10-299725 | | 11/1998 |
| JP | 2000-257604 | | 9/2000 |
| JP | 2002-206616 | | 7/2002 |

* cited by examiner

*Primary Examiner*—F. Daniel Lopez
(74) *Attorney, Agent, or Firm*—Paul A. Guss

(57) ABSTRACT

A cylinder apparatus comprises a piston which is displaced along a cylinder tube under the driving action of a driving section provided for a main cylinder body, while the piston is displaced under the pressing action of a pressure fluid supplied to the cylinder tube. The amount of the pressure fluid supplied to the main cylinder body is increased before a workpiece is engaged with a table section arranged at an end of the main cylinder body so that pressing force, which is applied to the piston, is increased. Accordingly, driving load, which is exerted on the driving section when the workpiece is engaged with the table section, is reduced.

5 Claims, 7 Drawing Sheets

A
B
C
D
E
X1
X2
L1
L2
W
16
26
28
30
32
34
38
40
42
44
46

METHOD FOR CONTROLLING OPERATION OF CYLINDER APPARATUS

BACKGROUND OF THE INVENTION

1. Field of the Invention

The present invention relates to a method for controlling operation of a cylinder apparatus. In particular, the present invention relates to a method for controlling operation of a cylinder apparatus, which makes it possible to displace a piston of the cylinder apparatus under the action of a pressure fluid and a driving section.

2. Description of the Related Art

A cylinder apparatus has been hitherto used, for example, such that a workpiece is attached to an end of a piston rod arranged for a cylinder, and pressure fluid is supplied to a cylinder chamber of the cylinder to displace the piston rod under the pressing action of the pressure fluid. Accordingly, the workpiece is transported and positioned at a target position.

When the workpiece is displaced by such a cylinder apparatus, the workpiece having a large load can be displaced, because output is large owing to the pressure fluid. However, it has been difficult to highly accurately position a workpiece, because pressure fluid is compressive fluid.

On the other hand, the following method is known. That is, a workpiece is attached to a ball screw provided for a cylinder apparatus, and the ball screw is rotated by a rotary driving source (for example, a motor) to displace the workpiece thereby. The operation is electrically controlled, and thus the workpiece is positioned highly accurately with respect to a target position.

A cylinder apparatus has been suggested, which is provided with both of the driving force brought about when the workpiece is displaced by the pressure fluid as described above and the positioning accuracy for the workpiece brought about under the driving action of the rotary driving source (see, for example, Japanese Laid-Open Patent Publication No. 9-210014).

In the case of the conventional technique disclosed in Japanese Laid-Open Patent Publication No. 9-210014, for example, load, which is exerted on the cylinder apparatus, is sometimes fluctuated, for example, due to the fluctuation of weight of a workpiece, when the cylinder apparatus is driven and/or when the cylinder apparatus is stopped. In such a situation, the amount of the pressure fluid supplied to the cylinder apparatus is increased/decreased in response to the fluctuation of the load of the workpiece, and driving force of the piston is changed to correspond to the load. However, it is difficult to instantaneously increase/decrease the amount of the pressure fluid supplied in response to the fluctuation of the load.

On the other hand, the driving force, which corresponds to the fluctuation of the load, can be obtained by instantaneously increasing/decreasing the driving torque of the rotary driving source by electric control. However, in this case, it is necessary that the rotary driving source having a large driving torque is previously provided in order to respond to fluctuation of the load brought about in the cylinder apparatus. Therefore, the rotary driving source is consequently large-sized, and the production cost of the cylinder apparatus is increased.

Further, large-sized rotary driving source is not required during ordinary operation in which the fluctuation of the load is not caused in the cylinder apparatus. Therefore, when a large-sized rotary driving source is always driven, unnecessary electricity is excessively consumed.

In recent years, it has been demanded to realize a smaller size of the cylinder apparatus, for example, to be installed in a small space in the cylinder apparatus.

SUMMARY OF THE INVENTION

A general object of the present invention is to provide a method for controlling operation of a cylinder apparatus in which positioning control of a workpiece is achieved highly accurately by reducing load exerted on a driving section when the load on a cylinder is fluctuated, while realizing a small size of the entire apparatus, power saving, and production cost reduction.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
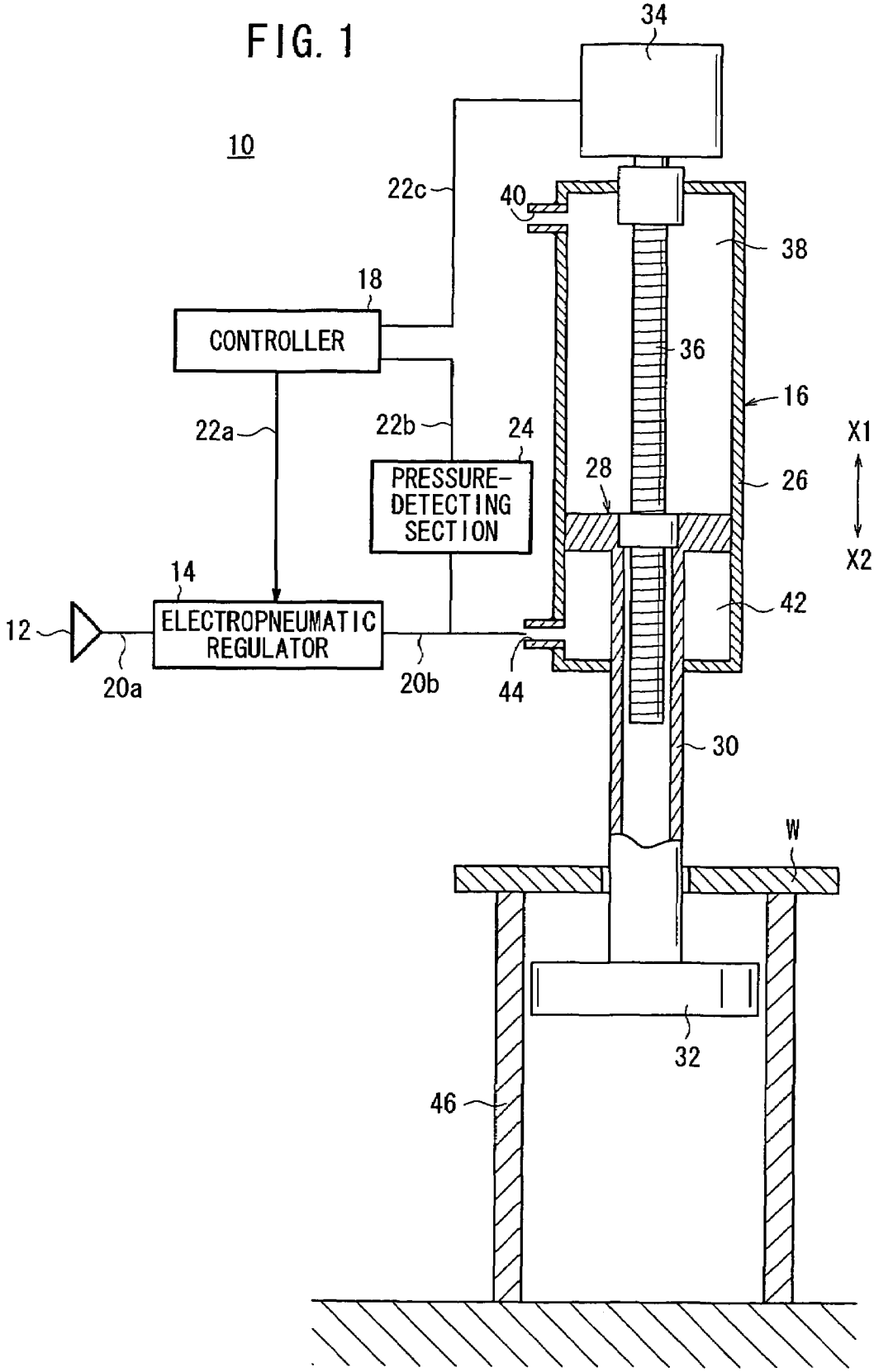
FIG. 1 is a schematic cross-sectional view illustrating an arrangement of a cylinder apparatus to which a method for controlling operation of the cylinder apparatus according to a first embodiment of the present invention is applied.

In FIG. 1, reference numeral 10 indicates a cylinder apparatus to which a method for controlling the operation of the cylinder apparatus according to a first embodiment of the present invention is applied.

As shown in FIG. 1, the cylinder apparatus 10 comprises a pressure fluid supply source 12 which supplies pressure fluid, an electropneumatic regulator (flow rate control unit) 14 which adjusts and outputs the pressure of the pressure fluid supplied from the pressure fluid supply source 12, a main cylinder body 16 to which the pressure fluid is supplied and which displaces a workpiece W by a predetermined amount, and a controller (control unit) 18 which outputs a control signal to the main cylinder body 16 and the electropneumatic regulator 14.

The pressure fluid supply source 12 is connected to the electropneumatic regulator 14 via a piping 20*a*. The electropneumatic regulator 14 is connected to the main cylinder body 16 via a piping 20*b*. The controller 18 is connected to the electropneumatic regulator 14, a pressure-detecting section 24 for detecting a pressure of the main cylinder body 16, and a driving section 34 of the main cylinder body 16 via wirings 22*a* to 22c. The control signal is outputted from the controller 18 to the electropneumatic regulator 14 and the driving section 34 via the wirings 22*a*, 22c. Further, a detection signal detected, for example, by the pressure-detecting section 24 is inputted into the controller 18 via the wiring 22*b*.

The main cylinder body 16 includes a cylinder tube (cylinder body) 26, a piston 28 which is provided displaceably in the cylinder tube 26, a table section 32 which is provided on a rod section 30 of the piston 28 and which is engageable with a workpiece W, the driving section 34 which is connected to an end of the cylinder tube 26 and which is driven and rotated based on the control signal supplied from the controller 18, and a ball screw shaft 36 which is connected to the driving section 34 and which is rotated integrally thereby. The driving section 34 is composed of, for example, a stepping motor or a DC motor.

The cylinder tube 26 is formed to have a cylindrical shape. The cylinder tube 26 has one end to which the driving section 34 is installed, and the other end into which the rod section 30 of the piston 28 is inserted. A first cylinder chamber 38 is formed in the cylinder tube 26 between the piston 28 and one end of the cylinder tube 26, which is communicated with the outside via a first port 40. On the other hand, a second cylinder chamber (cylinder chamber) 42 is formed between the piston 28 and the other end of the cylinder tube 26, which is connected to the pressure fluid supply source 12 and the electropneumatic regulator 14 via a second port 44.

The piston 28 is formed to have a substantially T-shaped cross section. The ball screw shaft 36 is screw-engaged with a substantially central portion of the piston 28 in the axial direction. The piston 28 is displaceable along the cylinder tube 26 (in the directions of the arrows X1, X2) under the rotary action of the ball screw shaft 36. In this arrangement, the piston 28 is provided with an unillustrated rotation stop mechanism. Therefore, the piston 28 makes no rotational displacement.

That is, as for the main cylinder body 16, the piston 28 is displaced in the axial direction (directions of the arrows X1, X2) under the rotary action of the driving section 34, and thus the rod section 30 and the table section 32 of the piston 28 are displaced in the axial direction. Simultaneously, pressure fluid is supplied to the second cylinder chamber 42 from the second port 44 of the cylinder tube 26. Accordingly, the piston 28 is displaced toward the driving section 34 (in the direction of the arrow X1) under pressure of the pressure fluid. In this situation, the first port 40 is open to the atmospheric air.

A placement stand 46, on which the workpiece W is to be placed, is arranged under the main cylinder body 16. The placement stand 46 is formed to have a cylindrical shape so that the table section 32 of the main cylinder body 16 is displaceable therein. The plate-shaped workpiece W is placed on the open upper end. The main cylinder body 16 and the placement stand 46 are arranged substantially coaxially.

Next, an explanation will be made about operation in which the workpiece W is moved upwardly to a predetermined position from the initial position at which the workpiece W is placed on the placement stand 46 in the cylinder apparatus 10 constructed as described above.

Figures 2A, 2B, 2C, 2D, 2E:
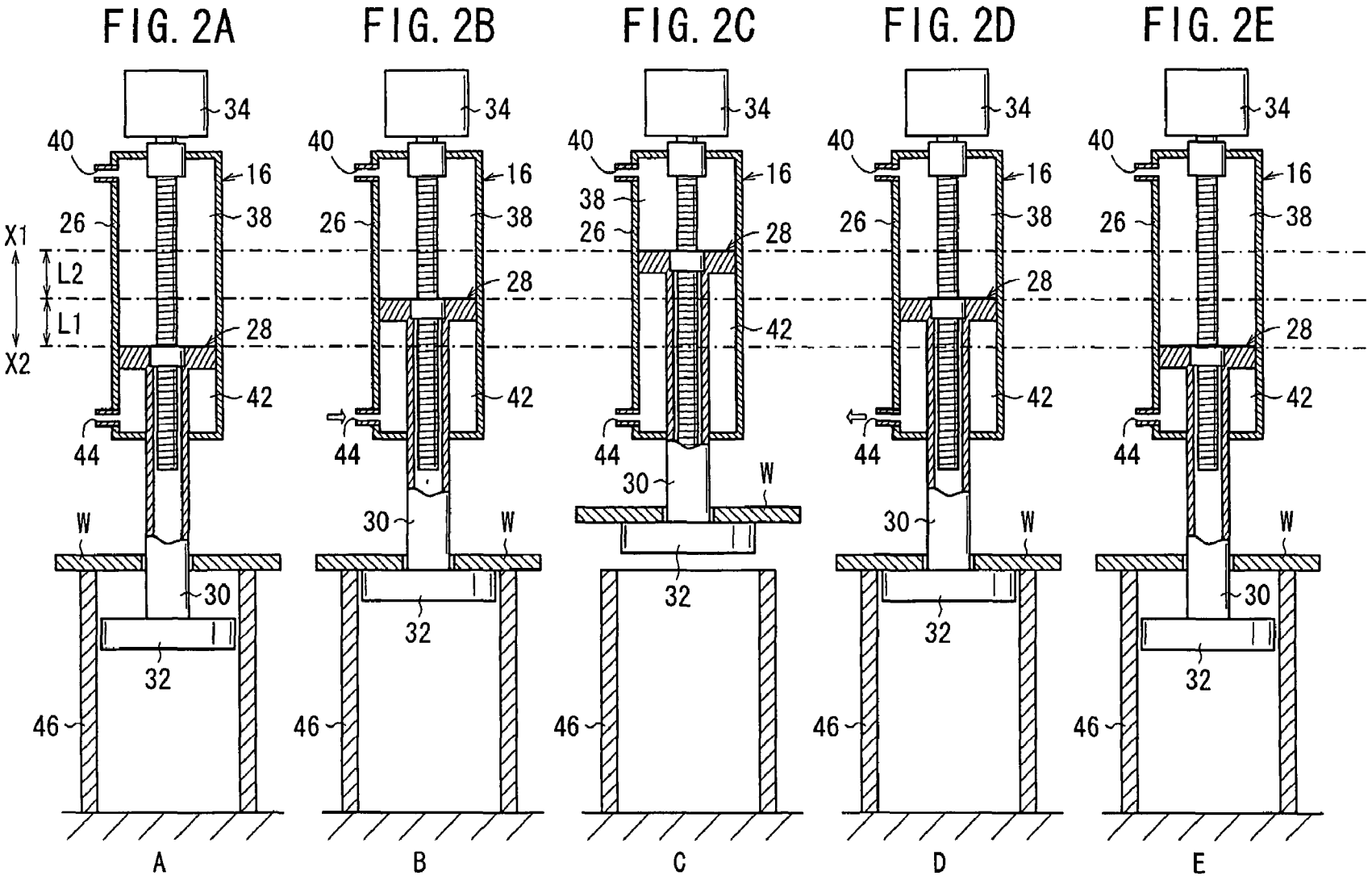
FIGS. 2A to 2E are schematic longitudinal sectional views illustrating operation to be performed when a workpiece placed on a placement stand is moved with the cylinder apparatus.

At first, as shown in FIGS. 1 and 2A, the main cylinder body 16 is arranged so that the driving section 34 is disposed on the upper side. The electropneumatic regulator 14 and the pressure fluid supply source 12 are connected via the piping 20 to the second port 44 of the cylinder tube 26. The rod section 30 of the main cylinder body 16 is inserted into the workpiece W on the upper side of the table section 32. The workpiece W is placed on the placement stand 46.

Starting from the initial state as described above, the control signal is outputted from the controller 18 to the electropneumatic regulator 14, and the control signal is outputted from the controller 18 to the driving section 34. Accordingly, the pressure fluid, which is supplied from the pressure fluid supply source 12, is supplied by a predetermined amount to the main cylinder body 16 in accordance with opening operation of the electropneumatic regulator 14 based on the control signal. The piston 28 of the main cylinder body 16 is pressed toward the driving section 34 (in the direction of the arrow X1) under pressure of the pressure fluid.

Figure 3:
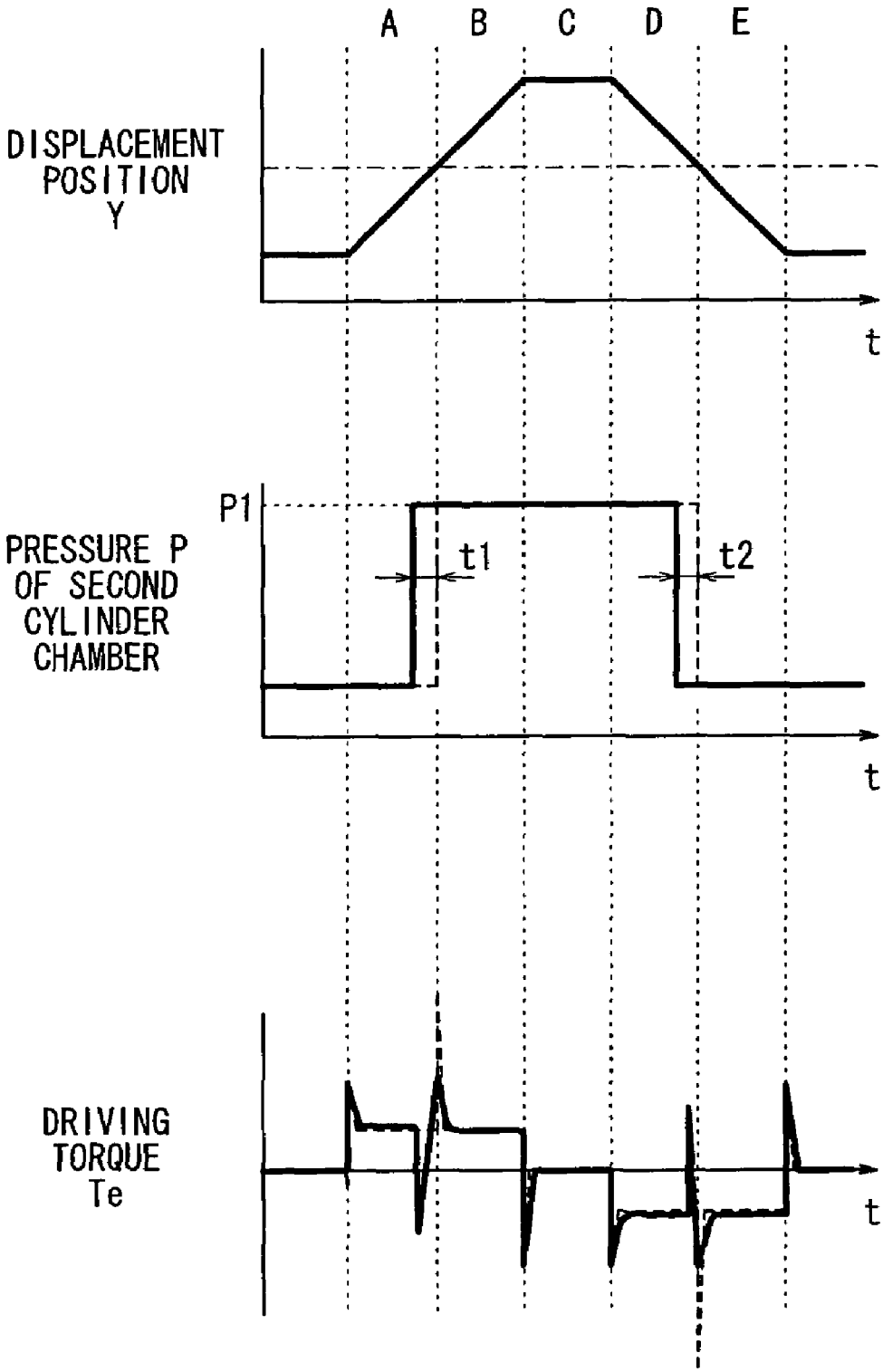
FIG. 3 is a diagram showing characteristic curves illustrating the relationships between the time and a displacement position of the workpiece, a pressure in a main cylinder body detected by a pressure-detecting section, and a driving torque of a driving section when the cylinder apparatus is driven as shown in FIG. 2.

Simultaneously, the driving section 34 is driven and rotated, and thus the ball screw shaft 36 is rotated. The piston 28 is displaced by a distance L1 toward the driving section 34 (in the direction of the arrow X1) under the screw-engaging action with the ball screw shaft 36 in addition to pressing force of the pressure fluid. In this situation, load on the driving section 34 is constant. Therefore, as shown in FIG. 3, driving torque of the driving section 34 is substantially constant (see the range A of the driving torque Te shown in FIG. 3). As a result, the table section 32 and the rod section 30 of the piston 28 are moved upwardly toward the driving section 34 (in the direction of the arrow X1) by the driving force of the driving section 34 and the pressing force of the pressure fluid supplied to the cylinder tube 26.

FIG. 3 shows characteristic curves illustrating the relationships between the time t, and a displacement position Y of the workpiece W, a pressure P of the second cylinder chamber 42 detected by the pressure-detecting section 24, and a driving torque Te of the driving section 34. With reference to FIG. 3, the characteristic curves depicted by solid lines indicate the case in which the method for controlling operation of the cylinder apparatus 10 according to the first embodiment is applied. The characteristic curves depicted by broken lines indicate the case in which a conventional method for controlling a cylinder apparatus. The ranges A to E shown in FIG. 3 correspond to A to E depicted for the respective operation states of the cylinder apparatus 10 shown in FIGS. 2A to 2E.

The control signal, which is previously set so that the pressure of the second cylinder chamber 42 becomes a desired preset pressure value P1, is outputted from the controller 18 to the electropneumatic regulator 14 before the table section 32 is moved upwardly to make abutment against the workpiece W placed on the placement stand 46. Accordingly, the amount of the pressure fluid supplied is increased for the main cylinder body 16, and the pressure of the second cylinder chamber 42 is increased to the preset pressure value P1. As a result, the piston 28 is pressed toward the driving section 34 (in the direction of the arrow X1) by a larger pressing force.

In particular, a period until fluctuation of load is caused when the piston 28 displaced from the initial position to abut against the workpiece W through the table section 32, is previously measured, and set in the controller 18. A control signal is outputted from the controller 18 to the electropneumatic regulator 14 and pressure fluid is supplied to the second cylinder chamber 42 of the main cylinder body 16 at the time which precedes, by a predetermined period of time, the timing at which the fluctuation of the load occurs, i.e., the point of time (boundary between the range A and the range B shown in FIG. 3) at which the table section 32 abuts against the workpiece W.

The time lag t1 between the timing at which the load fluctuation occurs and the timing at which the amount of the pressure fluid supplied is increased is arbitrarily set depending on the timing of the load fluctuation brought about for the piston 28, and is previously set in the controller 18.

The amount (pressure) of the pressure fluid supplied to additionally to the main cylinder body 16 is previously measured, for example, based on the shape, the weight of the workpiece W, and is set in the controller 18. In other words, the magnitude of load fluctuation brought about when the workpiece W is moved is predicted based on, for example, the weight of the workpiece W to control the amount of the pressure fluid supplied depending on the load fluctuation by the controller 18.

In this procedure, the pressure of the second cylinder chamber 42 is detected by the pressure-detecting section 24 via the piping 20*b*, and outputted from the pressure-detecting section 24 to the controller 18. The controller 18 compares the detected pressure value with the preset value of pressure fluid. The difference between the preset value and the pressure value is outputted as a feedback signal to the electropneumatic regulator 14. Accordingly, the supply amount of the pressure fluid is controlled, which makes it possible to maintain the second cylinder chamber 42 to be at the preset pressure.

Subsequently, as shown in FIG. 2B, when the table section 32 abuts against the workpiece W placed on the placement stand 46 and the workpiece W separates from the placement stand 46, the weight of the workpiece W is applied to the table section 32. However, the amount of the pressure fluid supplied is previously increased to increase the pressing force exerted on the piston 28 toward the driving section 34 (in the direction of the arrow X1). Therefore, it is possible to suppress the load due to the weight of the workpiece W applied to the driving section 34 when the workpiece W is moved upwardly. In this procedure, as shown in FIG. 3, the driving torque of the driving section 34 is increased by a slight amount when the workpiece W separates from the placement stand 46. However, the amount increased can be suppressed as compared with the amount increased of the driving torque of the rotary driving source in the conventional cylinder apparatus, because the pressing force by the pressure fluid is applied. After that, it is possible to operate the rotary driving source at a substantially constant driving torque (see the range B of the driving torque Te shown in FIG. 3).

In other words, the pressing force, which presses the workpiece W toward the driving section 34 (in the direction of the arrow X1) under pressure of the pressure fluid, is previously applied to the piston 28. Therefore, when the workpiece W is engaged with the table section 32 to raise it, the pressing force assists the driving force of the driving section 34.

Finally, as shown in FIG. 2C, when the workpiece W is further moved upwardly by a distance L2 by the table section 32, then the pressure fluid is supplied substantially constantly to the main cylinder body 16 to maintain the pressure of the second cylinder chamber 42, and the driving operation of the driving section 34 is stopped. That is, the workpiece W is retained only by the pressing force brought about by the pressure fluid (see the ranges C of the pressure P and the driving torque Te shown in FIG. 3).

Substantially, an explanation will be made about operation performed when the workpiece W, which is retained by the table section 32 of the main cylinder body 16 as shown in FIG. 2C, is moved downwardly to place the workpiece W on the placement stand 46 again.

At first, a control signal is outputted from the controller 18 to the driving section 34, and the driving section 34 is driven and rotated in the direction opposite to the above. Accordingly, the ball screw shaft 36 is rotated in the opposite direction, and the piston 28 is displaced in the direction (the direction of the arrow X2) separating from the driving section 34 under the screw-engaging action. In this situation, the load exerted on the driving section 34 is constant. Therefore, the driving torque of the driving section 34 is substantially constant.

The control signal is outputted from the controller 18 to the electropneumatic regulator 14 before the workpiece W is moved downwardly in the direction of the arrow X2 and the workpiece W is placed on the placement stand 46. The amount of the pressure fluid supplied to the main cylinder body 16 is decreased by a predetermined amount to lower the pressure of the second cylinder chamber 42. Accordingly, the pressing force urged on the piston 28 toward the driving section 34 (in the direction of the arrow X1) decreases.

In particular, outputting the control signal from the controller 18 to the electropneumatic regulator 14 precedes by a predetermined period of time, the point of time (boundary between the range D and the range E as shown in FIG. 3) at which the workpiece W separates from the table section 32 and is placed on the placement stand 46 to decrease the amount of the pressure fluid supplied to the second cylinder chamber 42 by a predetermined amount due to closing operation of the electropneumatic regulator 14.

In particular, a period of time from the state in which the workpiece W is retained by the table section 32 to the state in which the load fluctuation due to downward movement of the piston 28 to abut the workpiece W against the placement stand 46, is previously measured. The period of time is set in the controller 18. Outputting the control signal from the controller 18 to the electropneumatic regulator 14 precedes, by a predetermined period of time, the timing at which the load fluctuation occurs, i.e., the point of time (boundary between the range D and the range E as shown in FIG. 3) at which the workpiece W abuts against the placement stand 46 to decrease the amount of the pressure fluid supplied to the second cylinder chamber 42 of the main cylinder body 16.

The time lag t2 between occurrence of load fluctuation and a timing at which the amount of the pressure fluid supplied is decreased is arbitrarily set depending on the timing of the load fluctuation caused for the piston 28, and previously set in the controller 18. The time lag t2 may be set equivalently to the time lag t1 corresponding to the state of load fluctuation brought about when the workpiece W is retained by the table section 32. Alternatively, the time lag t2 and the time lag ti may be set individually.

The amount of the pressure fluid to be decreased with respect to the main cylinder body 16 is previously measured, for example, based on the shape, the weight of the workpiece W, and set in the controller. In other words, magnitude of load fluctuation brought about when the workpiece W is placed on the placement stand 46 is estimated, for example, based on the weight of the workpiece W to control by the controller 18 so that the amount of the pressure fluid decreases depending on the load fluctuation.

Substantially, as shown in FIG. 2D, when the workpiece W is displaced downwardly by the distance L2, and the workpiece W is placed on the upper end of the placement stand 46, then the load (weight) of the workpiece W, which has been applied to the table section 32, disappears. As a result, the driving load, which has been exerted by the workpiece W on the driving section 34, is reduced. In this procedure, the amount of the pressure fluid supplied is previously decreased to decrease the pressing force of the piston 28 applied toward the driving section 34 (in the direction of the arrow X1) before the workpiece W is placed on the placement stand 46. Accordingly, when the workpiece W is placed, the pressing force exerted on the piston 28 is not excessively increased. Sudden load fluctuation does not arise with respect to the driving section 34.

Finally, as shown in FIG. 2E, the driving section 34 is further driven to move the piston 28 downwardly by the distance L1. Accordingly, the workpiece W is placed on the placement stand 46 to return to the initial state in which the table section 32 is arranged inside the placement stand 46.

As described above, in the method for controlling the operation of the cylinder apparatus according to the first embodiment, the amount of the pressure fluid supplied to the main cylinder body 16 is increased/decreased by the controller 18 and the electropneumatic regulator 14 to control the pressure of the second cylinder chamber 42 highly accurately. The pressing force by the pressure fluid is previously increased/decreased before load fluctuation in the cylinder apparatus 10 occurs.

Accordingly, because the load fluctuation can be substantially balanced with the pressing force of pressure fluid applied to the piston 28, and the driving load of the driving section 34 can be reduced, it is possible to suppress the maximum peak of the driving torque of the driving section 34 (see the solid and broken lines of the driving torque Te shown in FIG. 3). As a result, the volume of the driving section 34 can be decreased as compared with the conventional cylinder apparatus. Accordingly, it is possible to realize a small size of the driving section 34, resulting in miniaturization and power saving of the cylinder apparatus 10.

The driving section 34 can be driven stably by suppressing the maximum peak of the driving torque of the driving section 34 (see the solid and broken lines of the driving torque Te shown in FIG. 3) as compared with the conventional method for controlling the cylinder apparatus. Therefore, it is possible to highly accurately control the displacement of the piston 28 of the main cylinder body 16, resulting in reliable and highly accurate positioning of the workpiece W.

Figure 4:
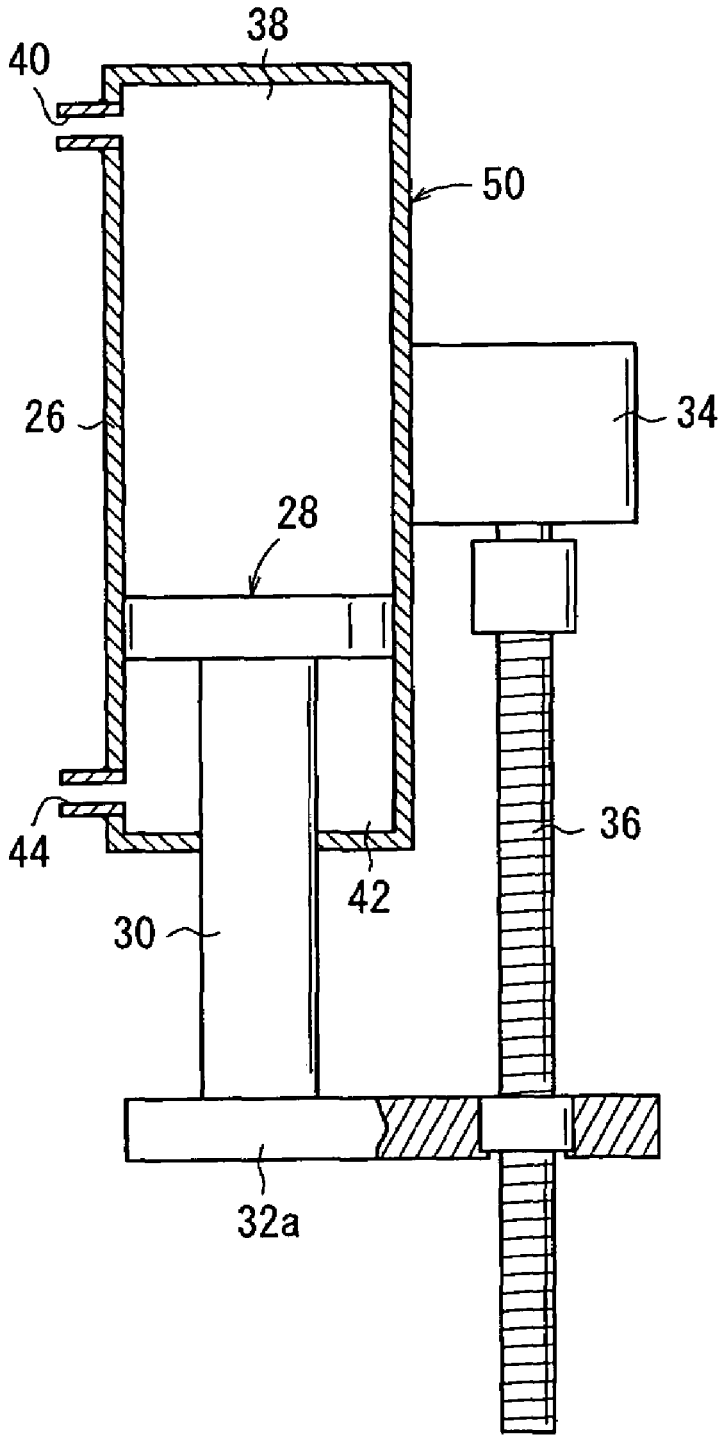
FIG. 4 is a schematic cross-sectional view illustrating a modified embodiment of the cylinder apparatus to which the method for controlling operation of the cylinder apparatus shown in FIG. 1 is applied.

The cylinder apparatus 10 as described above is not limited to the arrangement in which the piston 28 and the ball screw shaft 36 are arranged coaxially, but may be that in which the piston 28 is provided inside the cylinder tube 26, and the driving section 34 and the ball screw shaft 36 are arranged outside the cylinder tube 26, as is the cylinder apparatus 50 shown in FIG. 4. In this arrangement, the ball screw shaft 36 is screw-engaged with the table section 32*a*, and the table section 32*a* is directly displaced in the axial direction under the rotary action of the ball screw shaft 36.

Figure 5:
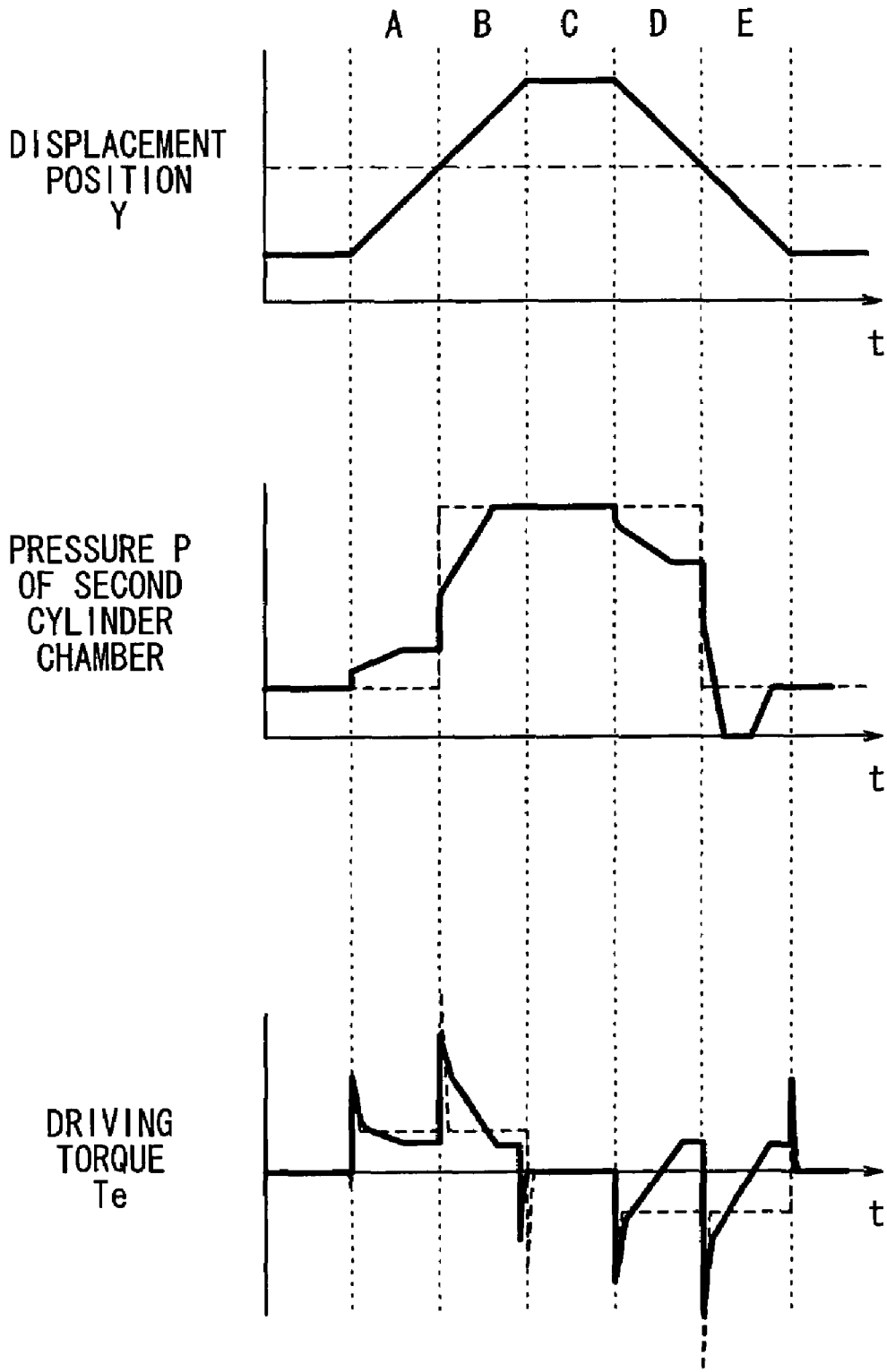
FIG. 5 is a diagram showing characteristic curves illustrating the relationships between the time, and a displacement position of the workpiece, a pressure in a main cylinder body detected by a pressure-detecting section, and a driving torque of a driving section when a cylinder apparatus is driven in accordance with a method for controlling the operation of the cylinder apparatus according to a second embodiment of the present invention.

Next, FIG. 5 shows a method for controlling the operation of a cylinder apparatus according to a second embodiment. The constitutive components, which are the same as those of the method for controlling the operation of the cylinder apparatus 10 according to the first embodiment described above, are designated by the same reference numerals, and detailed explanation thereof will be omitted. FIG. 5 shows characteristic curves illustrating the relationships between the time t and a displacement position Y of the workpiece W, a pressure P of the second cylinder chamber 42 detected by the pressure-detecting section 24, and a driving torque Te of the driving section 34. In FIG. 5, the characteristic curves depicted by solid lines indicate the case in which the method for controlling the operation of the cylinder apparatus according to the second embodiment is applied, and the characteristic curves depicted by broken lines indicate the case in which a conventional method for controlling a cylinder apparatus is applied. The symbols A to E shown in FIG. 5 correspond to A to E depicted for the respective operation states of the cylinder apparatus 10 shown in FIGS. 2A to 2E.

As shown in FIG. 5, the method for controlling the operation of the cylinder apparatus according to the second embodiment is different from the method for controlling the operation of the cylinder apparatus according to the first embodiment described above in that the driving torque of the driving section 34 is detected by the controller 18 to output the control signal from the controller 18 to the electropneumatic regulator 14 to respond to the increase/decrease in driving torque, and thus the amount of the pressure fluid supplied to the main cylinder body 16 is increased/decreased by the electropneumatic regulator 14.

In this operation control method, an unillustrated driving-detecting section (for example, an encoder), which is capable of detecting the angle of rotation or the amount of rotation of the driving section 34, is provided, and the detection result, which is detected by the driving-detecting section, is outputted as the output signal to the controller 18. Accordingly, the driving torque is calculated from the detection result by the controller 18. A control signal is outputted from the controller 18 to the electropneumatic regulator 14 so that the driving torque is substantially constant. The pressure fluid is supplied to the main cylinder body 16 by the electropneumatic regulator 14. That is, when the driving torque of the driving section 34 increases, the amount of the pressure fluid supplied is increased by an opening operation of the electropneumatic regulator 14 so that the pressure of the second cylinder chamber 42 increases to reduce load on the driving section 34 by pressing the piston 28 toward the driving section 34 (in the direction of the arrow A). As a result, driving torque is lowered.

On the other hand, when the driving torque of the driving section 34 is lowered, then the amount of the pressure fluid supplied is decreased by the closing operation of the electropneumatic regulator 14 so that the pressure of the second cylinder chamber 42 is lowered, resulting in increase in driving torque.

As described above, driving load on the driving section 34 is always detected by the driving-detecting section, and the driving load is outputted as the driving torque to the controller 18 and compared with a desired driving torque preset value, and then the pressure value of the pressure fluid, at which the driving torque preset value can be maintained, is calculated. The feedback signal, which is based on the calculated value, is outputted from the controller 18 to the electropneumatic regulator 14. Accordingly, the amount (pressure value) of the pressure fluid supplied to the main cylinder body 16 is controlled, and the pressing force applied to the piston 28 is controlled. As a result, the load on the driving section 34 can always be maintained to be substantially constant. That is, the feedback control is performed by detecting driving load on the driving section 34, and controlling the amount of the pressure fluid supplied so that driving torque of the driving section 34 is substantially constant depending on the driving load.

As described above, in the method for controlling the operation of the cylinder apparatus according to the second embodiment, when load on the driving section 34 is fluctuated, the amount of the pressure fluid supplied to the second cylinder chamber 42 is increased/decreased depending on the change of the driving torque of the driving section 34. Accordingly, the pressing force exerted on the piston 28 by the pressure fluid is substantially balanced with the load fluctuation. It is possible to reduce the driving load on the driving section 34. Therefore, it is possible to suppress the maximum peak of the driving torque of the driving section 34 (see the solid and broken lines in relation to the driving torque Te shown in FIG. 5) as compared with the conventional method for controlling the cylinder apparatus. Accordingly, it is possible to decrease a volume of the driving section 34 as compared with the conventional cylinder apparatus, resulting in miniaturization and power saving of the cylinder apparatus including the driving section 34.

Even when the condition of load fluctuation in the cylinder apparatus (for example, fluctuation amount and fluctuation timing) is not known beforehand, then the change of the driving torque of the driving section 34 is detected, and the amount of the pressure fluid supplied to the main cylinder body 16 can be changed based on the detection result. As a result, it is possible to reliably and appropriately reduce driving load on the driving section 34.

Figure 6:
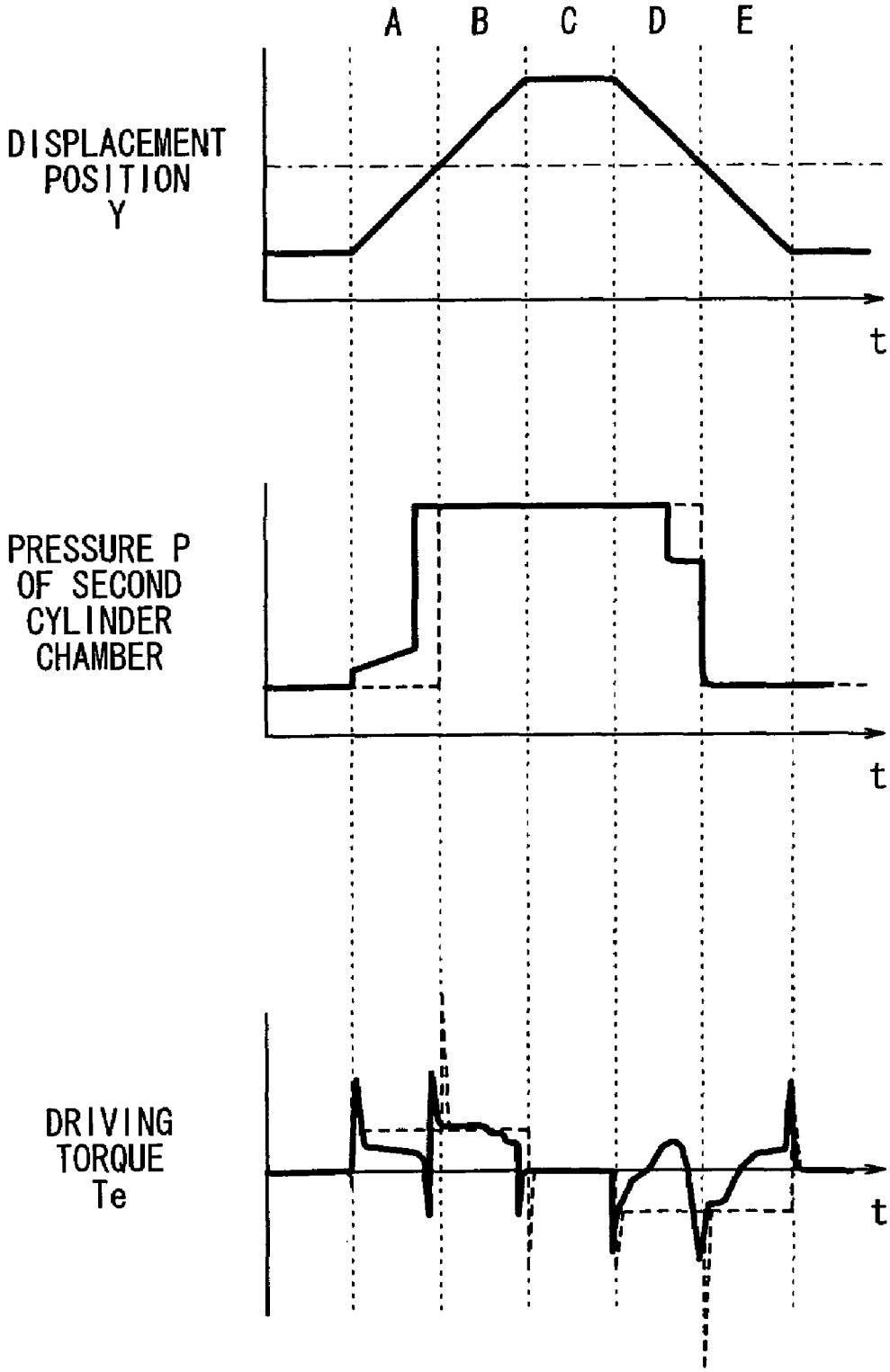
FIG. 6 is a diagram showing characteristic curves illustrating the relationships between time, and a displacement position of the workpiece, a pressure in a main cylinder body detected by a pressure-detecting section, and a driving torque of a driving section when a cylinder apparatus is driven in accordance with a method for controlling the operation of the cylinder apparatus according to a third embodiment of the present invention.

Next, FIG. 6 shows a method for controlling the operation of a cylinder apparatus according to a third embodiment. The constitutive components, which are the same as those of the methods for controlling the operation of the cylinder apparatus 10 according to the first and second embodiments described above, are designated by the same reference numerals, and detailed explanation thereof will be omitted. FIG. 6 shows characteristic curves illustrating the relationships between the time t and a displacement position Y of the workpiece W, a pressure P of the second cylinder chamber 42 detected by the pressure-detecting section 24, and a driving torque Te of the driving section 34. In FIG. 6, the characteristic curves depicted by solid lines indicate the case in which the method for controlling the operation of the cylinder apparatus according to the third embodiment is applied, and the characteristic curves depicted by broken lines indicate the case in which a conventional method for controlling a cylinder apparatus is applied. The symbols A to E shown in FIG. 6 correspond to A to E depicted for the respective operation states of the cylinder apparatus 10 shown in FIGS. 2A to 2E.

The method for controlling the operation of the cylinder apparatus according to the third embodiment is different from the methods for controlling the operation of the cylinder apparatus according to the first and second embodiments in that the predictive control in which pressing force by pressure fluid is increased/decreased before load fluctuation in the cylinder apparatus 10 occurs and the torque control in which the amount of the pressure fluid supplied to the main cylinder body 16 is increased/decreased based on the control signal outputted from the controller 18 to the electropneumatic regulator 14 are appropriately selected depending on the operation state of the cylinder apparatus 10.

In this method for controlling the operation of the cylinder apparatus, the predictive control in the cylinder apparatus 10 is selected when it is possible to correctly detect the position (stroke position of the piston 28) of load fluctuation in the cylinder apparatus 10 and the load and the load fluctuation amount before and after the load fluctuation. On the other hand, when it is difficult to correctly detect the position of the load fluctuation in the cylinder apparatus 10 and the load and the load fluctuation amount before and after load fluctuation the torque control in the cylinder apparatus 10 is selected.

That is, in the method for controlling the operation of the cylinder apparatus according to the third embodiment, the optimum control method is judged depending on the operation state of the cylinder apparatus 10. The combined control is performed by appropriately selecting the predictive control in which pressing force by pressure fluid is increased before load fluctuation in the cylinder apparatus 10 and the torque control in which the amount of the pressure fluid supplied to the main cylinder body 16 is increased/decreased in response to the increase/decrease in the driving torque of the driving section 34.

Figure 7:
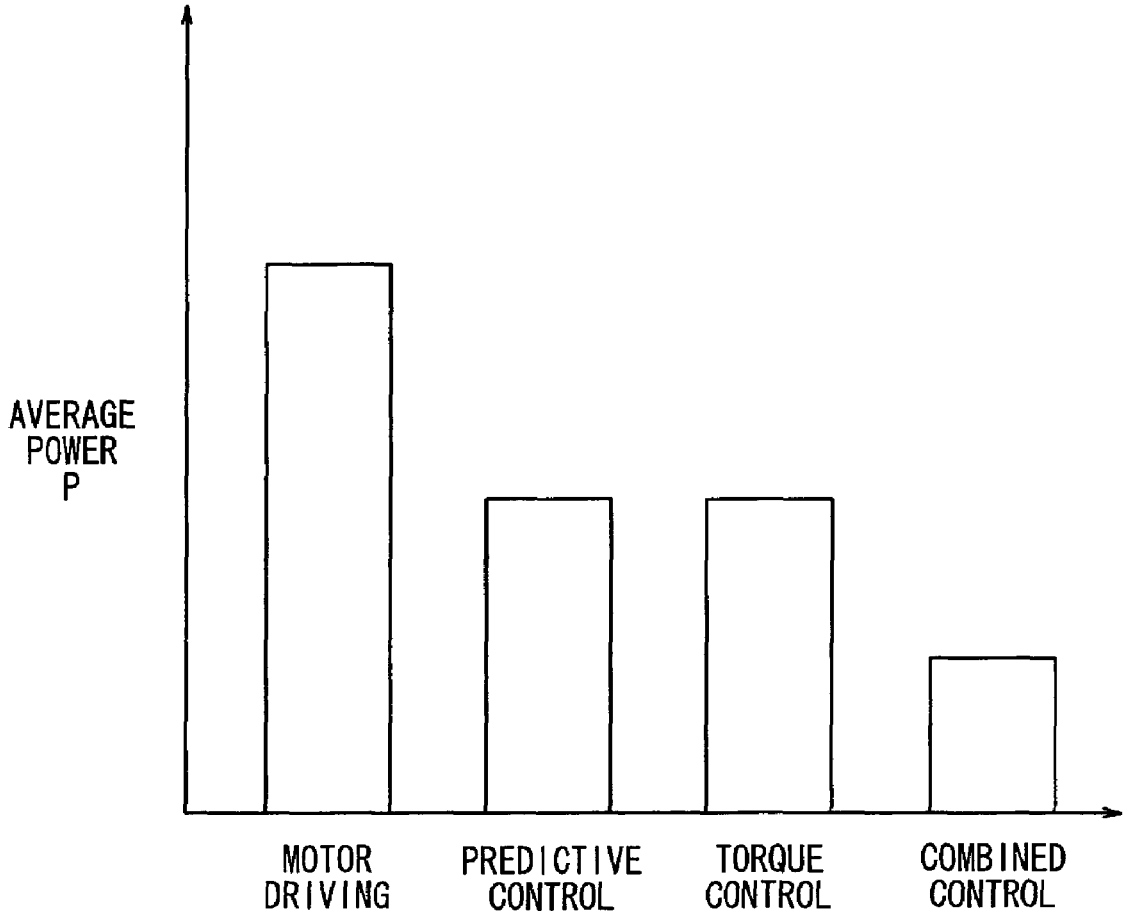
FIG. 7 is a comparative diagram showing the relationship of the average power in a combined control performed by the cylinder apparatus shown in FIG. 6, and a predictive control and a torque control performed by the cylinder apparatuses according to the first and second embodiments.

As described above, as shown in FIG. 7, in the method for controlling the operation of the cylinder apparatus according to the third embodiment, it is possible to decrease the average power P per one step of stroke displacement of the piston 28 in the cylinder apparatus as compared with the predictive control explained as the method for controlling the operation according to the first embodiment and the torque control explained as the method for controlling the operation according to the second embodiment. That is, the driving torque of the driving section 34 can further be reduced as compared with the methods for controlling operation of the cylinder apparatus according to the first and second embodiments. Accordingly, it is possible to save electric power of the cylinder apparatus.

In particular, when the predictive control is performed for the cylinder apparatus 10, it is possible to suppress the instantaneous torque upon load fluctuation, acceleration and deceleration of the cylinder apparatus 10. Further, when the torque control is performed, it is possible to suppress driving torque of the driving section 34.

Although certain preferred embodiments of the present invention have been shown and described in detail, it should be understood that various changes and modifications may be made therein without departing from the scope of the appended claims.

What is claimed is:

1. A method for controlling operation of a cylinder apparatus comprising a piston which is provided displaceably in a cylinder body, a ball screw which is engaged with said piston, and a driving section which drives and rotates said ball screw, wherein said piston is displaced by a driving force of said driving section and a pressure of a pressure fluid supplied to a cylinder chamber of said cylinder body to move a workpiece attached to said piston, said method comprising the steps of:

applying a weight load to said piston, said weight load applied to said piston fluctuating during a displacement range of said piston;

displacing said piston along said cylinder body by said ball screw under a driving action of said driving section;

supplying the pressure fluid to said cylinder chamber at a pressure corresponding to fluctuation of said weight load before said weight load applied to said piston is fluctuated so that a pressing force, which is substantially balanced with said weight load, is applied to said piston; and moving said piston by said driving force brought about by said driving section and said pressing force brought about by said pressure fluid.

2. The method for controlling operation of said cylinder apparatus according to claim 1, wherein said amount of said pressure fluid is previously set in a control unit, corresponding to said fluctuation of said weight load applied to said piston, and said amount is controlled by a control signal outputted from said control unit to a flow rate control unit.

3. The method for controlling operation of said cylinder apparatus according to claim 2, wherein a timing, at which said pressure fluid is supplied, is previously set in said control unit so that said timing precedes, by a predetermined period of time, a timing at which said weight load applied to said piston is fluctuated.

4. The method for controlling operation of said cylinder apparatus according to claim 1, wherein a timing, at which said pressure fluid is supplied, is previously set in said control unit so that said timing precedes, by a predetermined period of time, a timing at which said weight load applied to said piston is fluctuated.

5. A method for controlling operation of a cylinder apparatus comprising a piston which is provided displaceably in a cylinder body, a ball screw which is engaged with said piston, and a driving section which drives and rotates said ball screw, wherein said piston is displaced by a driving force of said driving section and a pressure of a pressure fluid supplied to a cylinder chamber of said cylinder body to move a workpiece attached to said piston, said method comprising the steps of:

applying a weight load to said piston, said weight load applied to said piston fluctuating during a displacement range of said piston;

displacing said piston along said cylinder body by said ball screw under a driving action of said driving section;

performing, during a portion of said displacement range, a step of supplying said pressure fluid to said cylinder chamber at a pressure corresponding to fluctuation of said weight load before said weight load applied to said piston is fluctuated so that a pressing force, which is substantially balanced with said weight load, is applied to said piston, and performing, during another portion of said displacement range, a step of detecting a driving torque of said driving section to compare said driving torque with a preset driving torque of said driving section set in a control unit, and calculating a pressure of said pressure fluid to be supplied corresponding to a difference between said preset driving amount and said driving amount detected to supply said pressure fluid to said cylinder chamber based on the calculated pressure; and moving said piston by said driving force brought about by said driving section and said pressing force brought about by said pressure fluid.

* * * * *